US011432643B2

(12) United States Patent
Serposi

(10) Patent No.: US 11,432,643 B2
(45) Date of Patent: Sep. 6, 2022

(54) BRUSH FOR THE APPLICATION OF COSMETIC PRODUCTS

(71) Applicant: PENNELLI FARO S.R.L., Casalmaggiore (IT)

(72) Inventor: Gianluca Serposi, Casalmaggiore (IT)

(73) Assignee: Pennelli Faro S.r.l., Casalmaggiore (IT)

( * ) Notice: Subject to any disclaimer, the term of this patent is extended or adjusted under 35 U.S.C. 154(b) by 657 days.

(21) Appl. No.: 16/317,937

(22) PCT Filed: Jun. 30, 2017

(86) PCT No.: PCT/IB2017/053977
§ 371 (c)(1),
(2) Date: Jan. 15, 2019

(87) PCT Pub. No.: WO2018/011665
PCT Pub. Date: Jan. 18, 2018

(65) Prior Publication Data

US 2021/0282540 A1 Sep. 16, 2021

(30) Foreign Application Priority Data

Jul. 15, 2016 (IT) ..... IT201600074568

(51) Int. Cl.

| | |
|---|---|
| ***A46B 9/02*** | (2006.01) |
| ***A46B 5/02*** | (2006.01) |
| ***A45D 33/36*** | (2006.01) |
| ***A45D 34/04*** | (2006.01) |
| ***A45D 40/28*** | (2006.01) |

(52) U.S. Cl.
CPC ..... *A46B 9/021* (2013.01); *A45D 33/36* (2013.01); *A45D 34/042* (2013.01); *A46B 5/02* (2013.01); *A46B 9/028* (2013.01); *A46B 2200/1046* (2013.01)

(58) Field of Classification Search
CPC ..... A46B 9/02; A46B 9/021; A46B 9/023; A46B 9/025; A46B 9/026; A46B 9/028; A46B 5/02; A46B 2200/1046; A45D 34/042; A45D 34/045; A45D 34/046; A45D 40/262; A45D 40/265; A45D 20/267
USPC ..... 401/121, 122, 128, 9–12
See application file for complete search history.

(56) References Cited

U.S. PATENT DOCUMENTS 3,097,386 A * 7/1963 Quirine ..... A45D 40/28 15/167.1
5,588,447 A * 12/1996 Gueret ..... A46B 9/06 132/200
6,312,182 B1 * 11/2001 Dumler ..... A46B 9/021 401/129

(Continued)

FOREIGN PATENT DOCUMENTS

FR 3024825 A1 2/2016
WO 2014013448 A1 1/2014

*Primary Examiner* — David J Walczak
(74) *Attorney, Agent, or Firm* — David B. Tingey; Bryant J. Keller; Kirton McConkie

(57) ABSTRACT

The brush for the application of cosmetic products comprises an housing seat for housing at least an application body having a plurality of spreading elements to spread a cosmetic product on a user, in which the housing seat comprises at least a concave portion and defining on the application body at least an application face of the cosmetic product.

7 Claims, 3 Drawing Sheets

(56) References Cited

U.S. PATENT DOCUMENTS

| | | | | |
|---|---|---|---|---|
| 7,565,714 | B2 * | 7/2009 | Gueret | A45D 34/045 15/143.1 |
| 2009/0038094 | A1 | 2/2009 | Kim | |

* cited by examiner

BRUSH FOR THE APPLICATION OF COSMETIC PRODUCTS

TECHNICAL FIELD

The present invention relates to a brush for the application of cosmetic products.

BACKGROUND ART

In the cosmetic sector, methods are known for the application of products such as creams, face powders, earth face powders, blush-ons, foundations, concealers and the like, which provide for the use of special brushes both to take the required quantities of product from the special containers and to apply the product on some particular points of the face and of the human body in general. Various types of brushes are known that differ in shape and size, to be used based on the type of application and the aesthetic result one wishes to obtain. Generally, all the brushes have a grip body particularly suited to be gripped and held by a user.

The grip body, usually elongated, may comprise, but is generally assembled, a housing seat provided with a special cavity adapted to accommodate a plurality of spreading elements, usually bristles or yarn, making up the application body of the brush itself, that is, the part of the brush adapted to take the product and apply the same on the surfaces to be treated.

The plurality of bristles is partly inserted into the cavity so as to be enclosed by the housing seat and retained therein by means of glue or other adhesive substances.

This subassembly is composed of the housing seat, generally referred to as a ring nut, and of the spreading elements, typically a tuft or a set of natural bristles or other yarn, and is referred to as the brush head.

In a first type of known brushes, the housing seat is substantially cylindrical and the spreading elements are inserted therein so as to form the application body, generally semispherical or with a variety of other shapes.

In a second type of known brushes, the housing seat has an oval shape so that the spreading elements inserted therein have a widened shape.

Generally, the brush is made starting from a base body with which the housing seat is assembled and in which the spreading elements are inserted and glued. Alternatively, the housing seat is formed directly inside a grip body of the brush.

The shapes of the brush heads of known type hardly allow at the same time rapid and precise applications, especially in the light of specific make-up application techniques such as the so-called "contouring" technique which involves the realization of three-dimensional visual effects in order to reduce and/or enhance particular facial features.

The use of this type of brushes results in a considerable increment of the time needed to carry out precision operations, or, in the case of limited time, inaccurate operations and with unsatisfactory final results.

Additional types of brushes are described in records FR3024825, WO2014/013448 and US2009/038094.

Document no. FR3024825 describes a brush for the application of cosmetic products comprising an application body having a plurality of shapes and profiles obtained by the insert of a discoid element in the housing seat.

Indeed, the discoid element comprises a shaped-crack formed by a specific shape and inside which spreading elements are placed.

The shape of the application body is then defined by its respective shape of the crack realized on the discoid element and exactly reproducing the crack; in other words, the shape of the application body is simply obtained by filling up the crack.

It is evident how said solutions brings up multiple inconvenient, in particular linked to the presence of the discoid element that, besides making the timing for the production and the assembly of the brush lasting longer, it reduces its solidity and durability through the years.

Indeed, the presence of a crack of small dimensions that, during the fabrication phase, it is filled with spreading elements defining the application body, reduces the total solidity of the brush and, as mentioned before, its relative durability through time.

Similarly, documents WO2014/013448 and US2009/038094 describe brushes in which the shape of the application body is linked to support bodies presenting defined conformations and to whom the spreading elements are connected. Also in this case, the association between the spreading elements and a support element inserted to measure in the housing seat, beside limiting the shapes of the application body, it determines a significant loss in the durability of the brush, causing the detachment of the spreading elements and considerably increasing the costs for the substitution of the brush itself

DESCRIPTION OF THE INVENTION

The main aim of the present invention is to provide a brush for the application of cosmetic products targeted to specific face areas, which allows performing precise operations by means of the optimization of the shape of the head and in this way of the application body also.

In light of this task, another object of the present invention is to provide a brush for the application of cosmetic products that allows simplifying and speeding up the application and spreading operations of the products, thus obtaining different aesthetic results with the use of a single brush.

Another object of the present invention it is to provide a brush for the application of cosmetic products that allows facilitating the process of fabrication and assembly of the same as for known types brushes.

A further object of the present invention it is to provide a brush for the application of cosmetic products that allows a significant increment of its durability compared to known types brushes, reducing the costs for substituting the brush itself.

A further object of the present invention is to provide a brush for the application of cosmetic products which allows to overcome the aforementioned drawbacks of the prior art within the ambit of a simple, rational, easy, efficient to use and cost-effective solution.

The objects outlined above are achieved by this brush for the application of cosmetic products having the characteristics of claim 1.

BRIEF DESCRIPTION OF THE DRAWINGS

Other characteristics and advantages of the present invention will become more evident from the description of a preferred, but not exclusive, embodiment of a brush for the application of cosmetic products, illustrated by way of an indicative, yet non-limiting example, in the joined drawings in which.

EMBODIMENTS OF THE INVENTION

Figure 1:
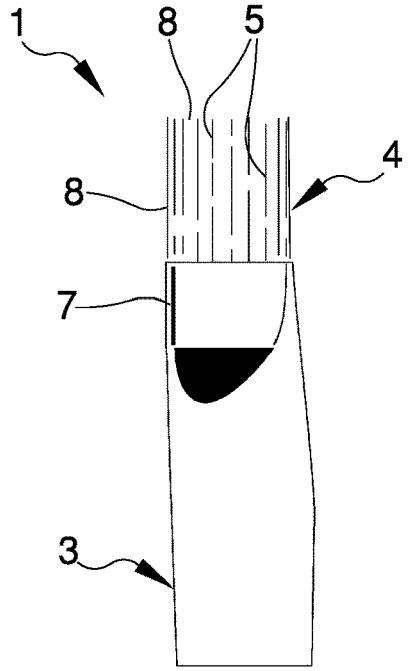
FIG. 1 is a side view of the brush according to the invention in a first embodiment.

With particular reference to these figures, reference numeral 1 globally indicates a brush for the application of cosmetic products.

The brush 1 comprises a housing seat 3 of an application body 4 usually having a plurality of spreading elements 5 to spread a cosmetic product on a user.

In the present discussion, the term "user" refers to the person designed to use the cosmetic product and not necessarily coinciding with the person using the brush 1.

Indeed, always in the field of the present invention, by the expression "cosmetic product" it is meant any substance, or mixture of substances, to be put on surfaces of the human body, with the exclusive or main aim, to modify its exterior appearance, clean, perfume, protect them and keep them in good state or correct its scents.

It is also specified that said cosmetic product presents itself in a suitable form to be taken, applied and blended using the brush 1.

More in detail, the cosmetic product can present itself indistinguishing in dust form or liquid lotion.

In particular, the spreading elements 5 are of the type of bristles, but other types of spreading elements 5 cannot be ruled out, such as synthetic yarn, polymeric material, or other material adapted to take and spread the products intended to treat and make up the skin of the user.

The brush 1 usually comprises a grip body, not shown in the figures, which is assembled or integral with the housing seat 3.

Alternative embodiments cannot therefore be ruled out wherein the grip body comprises an opening defining the housing seat 3.

According to the invention, the housing seat 3 comprises at least a concave portion 7 defining on the application body 4 at least an application face 8 of the cosmetic product.

In other words, the concave portion 7 defines on the application body 4 the base section of the shape of the housing seat 3.

By the term "application face" is meant both a portion of the application body 4 whose shape is defined according to the conformation of the housing seat, and the apical part properly adapted to take and apply the cosmetic product.

In other words, by the term "application face" 8 is meant any portion of the application body 4 designed for the application of the cosmetic product.

In detail, the concave portion 7 extends to the inside of the housing seat 3. Preferably, the concave portion 7 lies on a plane substantially orthogonal to the application body 4.

Figure 2:
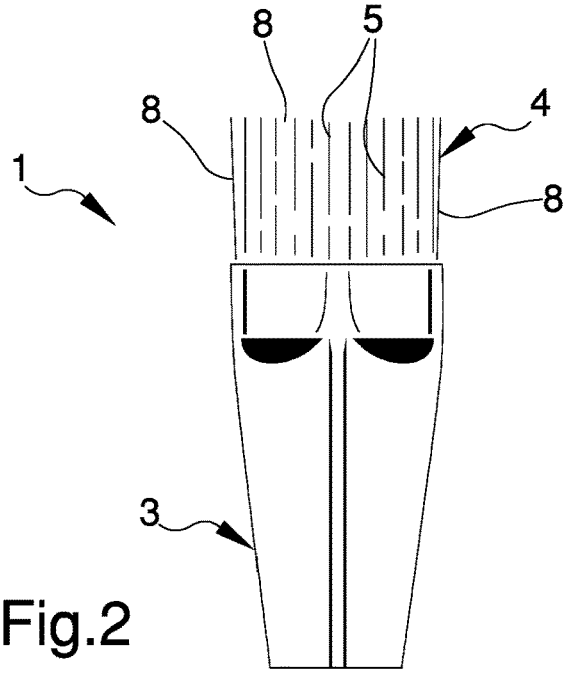
FIG. 2 is a front view of the brush of FIG. 1.
Figure 3:
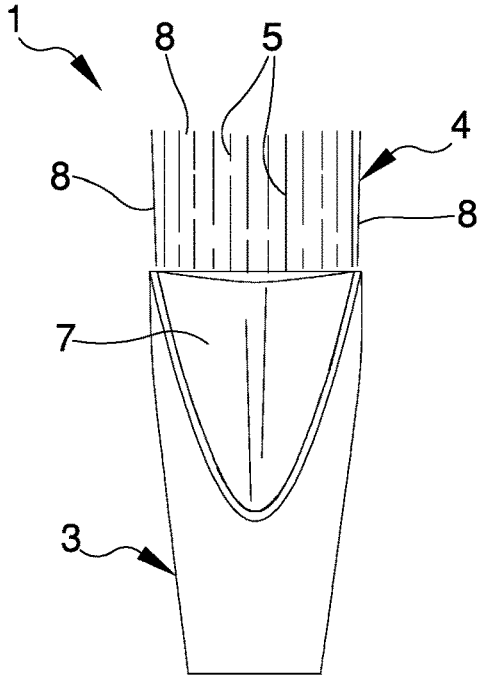
FIG. 3 is a rear view of the brush of FIG. 1.
Figure 4:
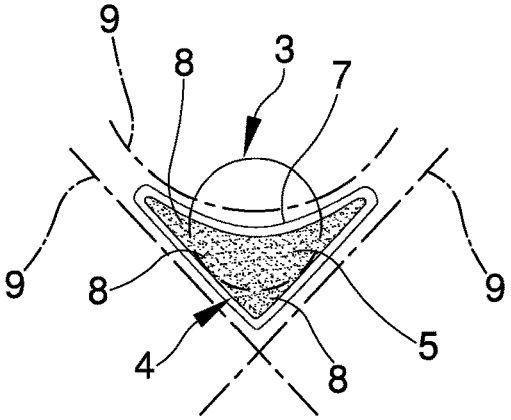
FIG. 4 is a top view of the brush of FIG. 1.

As can be seen in FIGS. 1-4, the concave portion 7 has a substantially curvilinear profile.

In particular, the concave portion 7 extends along a deformation surface 9 having a predefined conformation.

The deformation planes 9 and their mutual arrangement give the concave portion 7 a specific shaping; this allows making application faces 8 the arrangement of which is substantially complementary to the portions of the user's face such as the nasal septum or the mandibular profile.

Preferably, the deformation planes 9 are substantially incident to one another. The intersection of the deformation planes 9, i.e. the edge, lies on a plane parallel to the sagittal plane of the housing seat 3.

However, in the case of non-planar deformation surfaces 9, these are in any case to be considered as aligned with the major axis of the housing seat 3.

Figure 5:
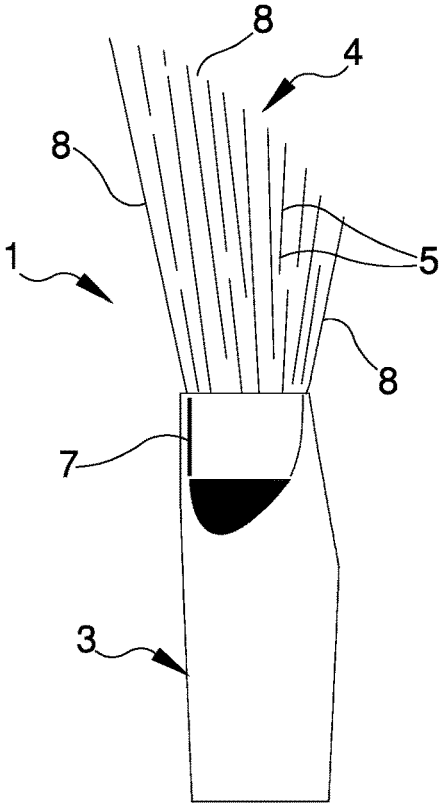
FIG. 5 is a side view of the brush according to the invention in a second embodiment.
Figure 6:
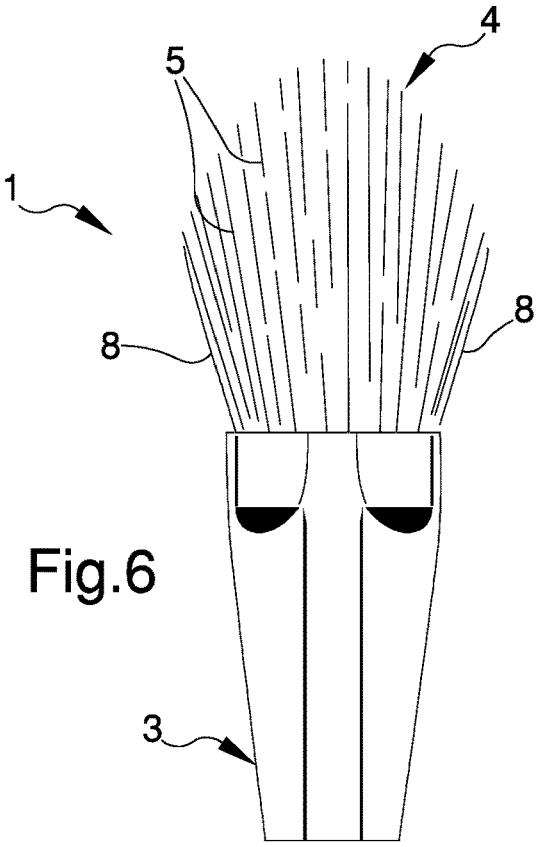
FIG. 6 is a front view of the brush of FIG. 5.
Figure 7:
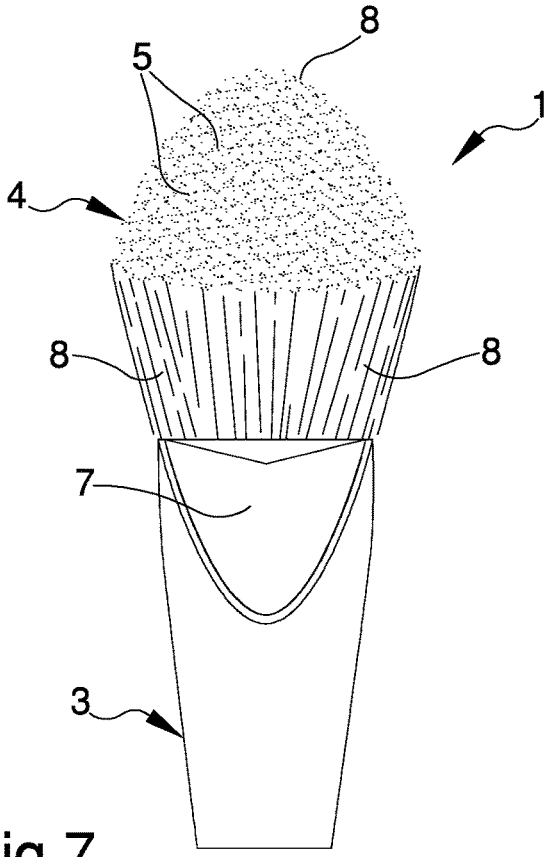
FIG. 7 is a rear view of the brush of FIG. 5.
Figure 8:
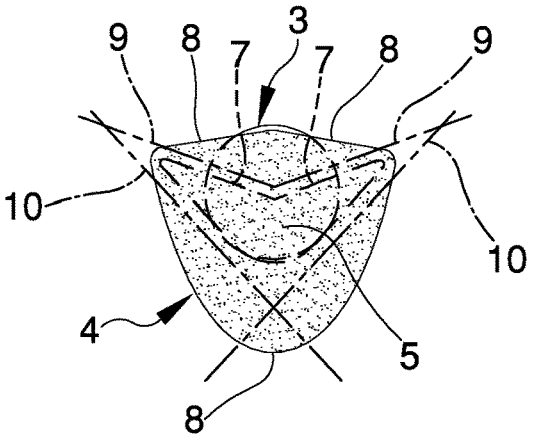
FIG. 8 is a top view of the brush of FIG. 5.
Figure 9:
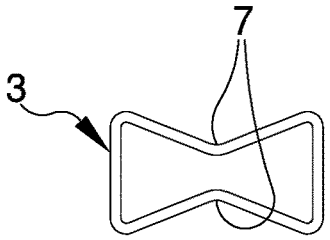
FIGS. 9-16 are schematic representations of cross sections of the housing seats of the brush according to the invention in alternative embodiments.
Figure 10:
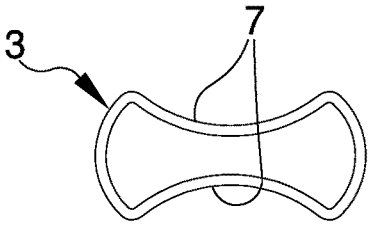
Figure 11:
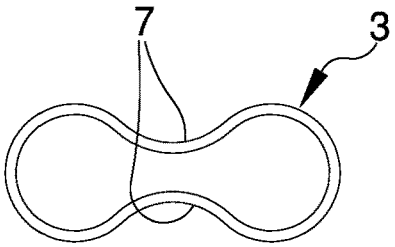
Figure 12:
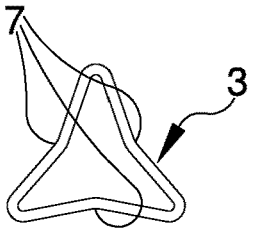
Figure 13:
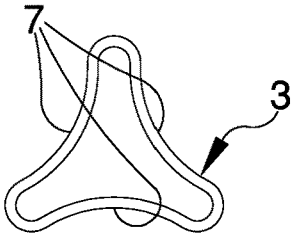
Figure 14:
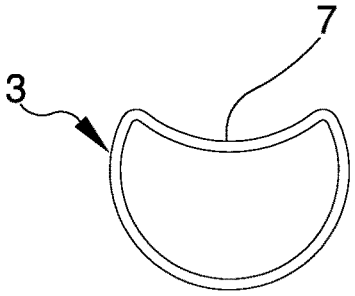
Figure 15:
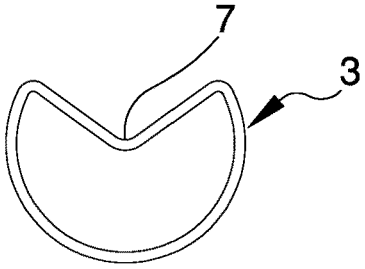
Figure 16:
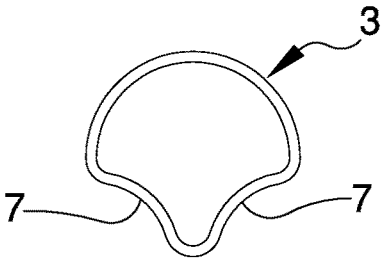

With reference to the particular embodiment shown in FIGS. 5-8, the deformation planes 9 are converging towards the inside of the housing seat 3. Preferably, but not exclusively, the housing seat 3 has at least a convex portion made on a portion of the housing seat itself opposite to the concave portion 7, and extending along relative deformation surfaces 10; this allows to reproduce the pattern of the user's facial features.

Alternative embodiments cannot also be ruled out wherein the deformation planes 9 are substantially non-parallel to each other; in this case, the application faces 8 may be angled to each other in a convergent, divergent, symmetric, asymmetric manner to form at least a concave portion in order to reproduce any shape of the human body for which it is possible to apply cosmetics with the present invention.

At the same time, the orientation of the deformation planes or surfaces 9 give the application body 4 different shapes and contours.

In other words, the deformation planes or surfaces 9, 10 give the application faces 8 an inclination defined according to the users' needs and to the final aesthetic effect that one wishes to obtain.

This means that the application body 4 takes on a cross section generated by the inclination of the deformation planes or surfaces 9, 10.

This particular conformation allows the user a plurality of modes of use, both relying on application faces 8 having different lengths and on edges having different angles.

This way, depending on the type of surface or on the type of application, the user can modulate the amount of cosmetic product taken and differentiate the modes of application of the cosmetic product itself by using at will the application faces 8 and/or the edges with which to take and spread the product. At the same time, the variability of the surfaces available to the user allows the gradual application of the cosmetic product, thus obtaining shaded effects which may vary depending on the specific shape of the application body 4.

The particular conformation of the application body 4, having the concave portion 7 substantially complementary to the user's nasal septum, allows applying and spreading the cosmetic product on the user's nose through an individual passage of the brush 1.

Similarly, the application and spread of the cosmetic product also on the mandibular profile of the user allows applying and spreading the cosmetic product itself with just one passage of the brush 1.

Before the detailed description of the functioning of the present invention and of its particular structural characteristics it is good to underline that the presence of deformation planes along which it develops a concave portion, it allows the realization a plurality of shapes of the application body, without using support elements realizing specific shapes.

More in particular, the realization of concave and/or convex portions on the housing seat allows to realize directly on the application body a plurality of application faces and corners with which it is possible to apply the cosmetic product following the conformation and portion of the face of the user, like the nasal septum or the mandibular profile.

To that, it is added that by realizing concave and/or convex portions that develop along the deformation planes with a defined inclination and orientation, it is possible to dispatch technical effect that are completely different compared to the ones described in document FR3024825, WO2014/013448 and US2009/038094.

In particular, the technical effect related to the presence of concave and/or convex portions allows to simplify and speed up the operation of applying and blending of the products, obtaining different esthetic results by using only one brush, following for complementarity specific portions of the face.

Furthermore, presenting the spreading elements directly housed into the housing seat, avoiding the use of support elements that can be insert into the housing seat itself, facilitate the fabrication and assembly procedure of the brush together with the increment in the durability of the brush itself.

The operation of the present invention is as follows.

Through the grip body, the brush 1 is maneuvered and brought closer to the cosmetic product to be taken, by placing in contact the application body 4, i.e. the plurality of spreading elements 5, with the cosmetic product itself so as to capture the desired amount of product.

If an even product spreading is required, the latter is subsequently applied onto one portion of the user's skin by laying the concave portion 7 and the respective application faces 8 e.g. astride of the nasal septum or of the mandibular profile; this way it is possible to exploit the mutual inclination of the application faces 8 to apply and spread the cosmetic product.

Alternatively, in the event of faded aesthetic effects being created, the brush 1 is maneuvered by exploiting the inclination of the application faces 8; the inclination in fact promotes the creation of shading and three-dimensional aesthetic effects.

It has in practice been found that the disclosed invention achieves the intended objects.

It should be emphasized that the particular solution of providing a deformed concave portion adapted to form application faces on the application body allows the latter to take on different shapes, performing precision operations without any waste of time and cosmetic product.

The application faces make the application body versatile and suitable for different types of operations, as well as being particularly adapted to take and position the right amount of product accurately, shading them quickly.

Furthermore, the presence of at least a concave portion deformed by deformation planes having different inclinations allows reaching difficult accessing areas quickly and easily.

The invention claimed is:

1. A cosmetic brush for application of cosmetic products, comprising at least a housing seat for housing at least an application body having a plurality of spreading elements to spread a cosmetic product on a user, wherein said housing seat comprises at least a concave portion and defining on said application body at least an application face of said cosmetic product, wherein said concave portion extends along a plurality of deformation planes with predefined inclination, wherein such plurality of deformation planes are substantially incident to one another and converging towards an inside of said housing seat to allow reproduction of a pattern of a facial feature of the user selected from (i) a nose of the user and (ii) a mandibular profile of the user, and wherein said housing seat comprises at least a convex portion made on a portion of said housing seat opposite to said concave portion, and extending along relative deformation surfaces.

2. The cosmetic brush according to claim 1, wherein said concave portion lies on a plane substantially orthogonal to said application body.

3. The cosmetic brush according to claim 1, wherein said cosmetic brush comprises a grip body associable with said housing seat.

4. The cosmetic brush according to claim 3, wherein said grip body comprises an opening which defines said housing seat.

5. The cosmetic brush according to claim 1, wherein said housing seat comprises a widened ending part having an opening which comprises the application body.

6. A cosmetic brush, comprising at least a housing seat for housing at least an application body having a plurality of spreading elements to spread a cosmetic product on a face of a user, wherein said housing seat comprises a concave portion and is configured to define on said application body at least an application face of said cosmetic product wherein said concave portion extends along two deformation planes with predefined inclination which are incident to one another and which converge towards an inside of said housing seat to allow said application body to reproduce a pattern of at least one facial feature of the user, said housing seat comprising at least a convex portion made on a portion of said housing seat opposite to said concave portion, and extending along relative deformation surfaces.

7. A cosmetic brush, comprising at least a housing seat for housing at least an application body having a plurality of spreading elements to spread a cosmetic product on a face of a user, wherein said housing seat comprises at least a concave portion and defining on said application body at least an application face of said cosmetic product wherein said concave portion extends along a two deformation planes with predefined inclination which are incident to one another and converge towards an inside of said housing seat allow said application body to reproduce a pattern of at least one facial feature selected from (i) a nose of the user and (ii) a mandibular profile of the user, said housing seat comprising at least a convex portion made on a portion of said housing seat opposite to said concave portion, and extending along relative deformation surfaces.

* * * * *